US009435545B2

(12) United States Patent
Chin et al.

(10) Patent No.: US 9,435,545 B2
(45) Date of Patent: Sep. 6, 2016

(54) HOME APPLIANCE

(71) Applicants: LG ELECTRONICS INC., Seoul (KR); PUSAN NATIONAL UNIVERSITY INDUSTRY-UNIVERSITY COOPERATION FOUNDATION, Busan (KR)

(72) Inventors: Jaemyung Chin, Seoul (KR); Sungho Choi, Seoul (KR); Yoongho Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 53 days.

(21) Appl. No.: 14/553,638

(22) Filed: Nov. 25, 2014

(65) Prior Publication Data

US 2015/0145397 A1 May 28, 2015

(30) Foreign Application Priority Data

Nov. 26, 2013 (KR) ..... 10-2013-0144529

(51) Int. Cl.
*E05F 1/10* (2006.01)
*F24C 15/02* (2006.01)
*A47L 15/42* (2006.01)

(52) U.S. Cl.
CPC ..... *F24C 15/023* (2013.01); *A47L 15/4261* (2013.01); *E05F 1/1025* (2013.01); *E05Y 2201/638* (2013.01); *E05Y 2900/30* (2013.01); *E05Y 2900/308* (2013.01); *Y10T 16/5387* (2015.01); *Y10T 16/53885* (2015.01); *Y10T 16/53888* (2015.01)

(58) Field of Classification Search
CPC ... E05F 1/1207; E05F 1/1215; E05F 1/1223; E05F 1/10; E05F 1/1008; E05F 1/1016; E05F 1/1025; E05F 1/1033; E05F 1/1041; E05F 1/105; E05F 1/1058; E05F 1/1066; E05F 1/1075; Y10T 16/5387; Y10T 16/5388; Y10T 16/53885; Y10T 16/53888
See application file for complete search history.

(56) References Cited

U.S. PATENT DOCUMENTS 1,200,538 A * 10/1916 Smith et al. ..... E05D 11/1078 16/303
5,724,683 A * 3/1998 Sorimachi ..... A47K 13/12 16/303
5,923,751 A * 7/1999 Ohtsuka ..... H04M 1/0218 379/433.13

(Continued)

FOREIGN PATENT DOCUMENTS

KR 10-2006-0134521 A 12/2006
KR 10-2013-0089456 A 8/2013

*Primary Examiner* — Jeffrey O Brien
(74) *Attorney, Agent, or Firm* — Ked & Associates, LLP

(57) ABSTRACT

Disclosed is a home appliance. The home appliance includes a cabinet having a chamber configured to receive an object therein, a door configured to open or close the chamber, a cam assembly configured to convert rotation into horizontal linear movement upon rotation of the door, and a spring configured to be compressed by horizontal linear movement of the cam assembly. The cam assembly has a variable horizontal linear movement distance for compression of the spring according to a rotation angle of the door.

15 Claims, 7 Drawing Sheets

(56) References Cited

U.S. PATENT DOCUMENTS 5,996,132 A * 12/1999 Sorimachi ..... A47K 13/12 16/303
5,996,178 A * 12/1999 Murray ..... H04M 1/0216 16/284
6,085,387 A * 7/2000 Han ..... H04M 1/0216 16/303
6,115,886 A * 9/2000 Fujita ..... G06F 1/1616 16/284
6,292,980 B1 * 9/2001 Yi ..... H04M 1/0216 16/303
6,886,221 B2 * 5/2005 Minami ..... H04M 1/0216 16/303
7,027,294 B2 * 4/2006 Kato ..... G06F 1/1616 361/679.08
7,062,817 B2 * 6/2006 Lee ..... E05D 7/1005 16/303
7,085,375 B2 * 8/2006 Katoh ..... H04M 1/0216 16/303
7,168,134 B2 * 1/2007 Minami ..... G06F 1/1616 16/303
7,184,275 B2 * 2/2007 Yamaguchi ..... H04M 1/0216 16/285
7,228,596 B2 * 6/2007 Kang ..... E05D 11/1078 16/263
7,299,524 B2 * 11/2007 Luo ..... G06F 1/1616 16/303
7,383,618 B2 * 6/2008 Lu ..... H04M 1/0216 16/303
7,480,961 B2 * 1/2009 Yang ..... H04M 1/0216 16/303
7,596,830 B2 * 10/2009 Yin ..... G06F 1/1616 16/303
7,613,293 B2 * 11/2009 Son ..... H04M 1/0216 379/433.11
7,631,397 B2 * 12/2009 Yin ..... G06F 1/1616 16/303
7,712,186 B2 * 5/2010 Kang ..... E05D 11/1078 16/330
7,784,153 B2 * 8/2010 Lin ..... E05F 1/1215 16/303
7,818,845 B2 * 10/2010 Hu ..... H04M 1/0216 16/303
7,913,359 B2 * 3/2011 Duan ..... E05F 1/1207 16/277
7,971,318 B2 * 7/2011 Kim ..... E05D 11/1078 16/303
8,079,115 B2 * 12/2011 Zhang ..... H04M 1/0216 16/316
8,099,831 B2 * 1/2012 Lee ..... H04M 1/0216 16/303
8,182,055 B2 * 5/2012 Yun ..... E05F 1/1215 188/290
8,266,766 B2 * 9/2012 Huang ..... G06F 1/1681 16/303
8,459,754 B2 * 6/2013 Cho ..... D06F 9/14 16/285
8,646,152 B2 * 2/2014 Lin ..... E05F 1/1207 16/330
9,060,051 B2 * 6/2015 Kitamura ..... H04M 1/0216
2005/0193523 A1 * 9/2005 Nam ..... E05D 11/06 16/330
2006/0117527 A1 * 6/2006 Tu ..... E05F 1/1016 16/303
2006/0123596 A1 * 6/2006 Chen ..... H04M 1/0216 16/337
2006/0255045 A1 * 11/2006 Kim ..... E05D 11/1078 220/531
2008/0136297 A1 * 6/2008 Huang ..... G06F 1/1681 312/219
2009/0100641 A1 * 4/2009 Yang ..... E05D 11/1078 16/303
2009/0260183 A1 * 10/2009 Chen ..... H04M 1/0214 16/223
2010/0024165 A1 * 2/2010 Kosugi ..... H04M 1/0216 16/303
2010/0180401 A1 * 7/2010 Duan ..... G06F 1/1616 16/250
2011/0088219 A1 * 4/2011 Huang ..... G06F 1/1681 16/319
2011/0157787 A1 * 6/2011 Duan ..... H04M 1/0216 361/679.01
2011/0203077 A1 * 8/2011 Kitamura ..... H04M 1/0216 16/297
2011/0254417 A1 * 10/2011 Duan ..... G06F 1/1681 312/319.2
2011/0316401 A1 * 12/2011 Cummins ..... E05F 1/1066 312/319.2
2015/0345203 A1 * 12/2015 Vanini ..... E05D 3/02 16/53

* cited by examiner

HOME APPLIANCE

CROSS-REFERENCE TO RELATED APPLICATION(S)

This application claims priority under 35 U.S.C. §119 to Korean Patent Application No. 10-2013-0144529, filed on Nov. 26, 2013, whose entire disclosure is hereby incorporated by reference as if fully set forth herein.

BACKGROUND

1. Field

The present invention relates to home appliances and, more particularly, to home appliances which may improve user convenience upon opening of a door, more particularly, door opening sensation.

2. Background

Home appliances may refer to household or indoor products that perform various functions using electricity or other forms of energy.

Examples of the home appliances include washing machines to wash or dry laundry, refrigerators to store food in a refrigerated or frozen state, dishwashers to wash dishes, ovens or microwave ovens to cook food, and the like. Of course, there may be various other types of home appliances.

In most cases, the home appliances may include a cabinet defining an external appearance of the home appliance. In addition, the cabinet may have a chamber in which an object is received. Thus, the cabinet may be said as defining the chamber.

For example, the chamber may provide any of various spaces according to shapes or purposes thereof including a food cooking space, a laundry washing space, a clothes storage or processing space, a dish washing space, a food storage space or the like. Of course, the chamber may be referred to by various terms according to use purposes of the home appliances.

The home appliances may include a door to be opened or closed for introduction and removal of an object. In addition, the door may be provided with a handle to allow a user to grip the handle and open or close the door.

There is a need to increase user convenience by allowing a user to easily open or close the door via the handle. That is, it is necessary to vary the magnitude of door damping force to assist the user in sensing a favored magnitude of force according to an opening angle upon opening of the door.

SUMMARY OF THE INVENTION

Accordingly, the present invention is directed to a home appliance that substantially obviates one or more problems due to limitations and disadvantages of the related art.

An object of the present invention is to provide a home appliance which has improved door opening sensation upon opening of a door of the home appliance by a user.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

In accordance with one embodiment of the present invention, a home appliance may include a cabinet having a chamber configured to receive an object therein, a door configured to open or close the chamber, a cam assembly configured to convert rotation into horizontal linear movement upon rotation of the door, and a spring configured to be compressed by horizontal linear movement of the cam assembly, wherein the cam assembly has a variable horizontal linear movement distance for compression of the spring according to a rotation angle of the door.

The horizontal linear movement distance of the cam assembly may increase on the basis of the same rotation angle as a degree of opening the chamber by the door increases.

The cam assembly may include a first cam configured to be rotated along with the door and a second cam configured to be linearly moved via rotation of the first cam.

At least one of the first cam or the second cam may include a plurality of guide faces having different gradients at portions thereof coming into contact with the other cam.

The guide faces may include a first guide face, a second guide face and a third guide face respectively having different constant gradients according to a rotation angle of the door.

The gradients may decrease in the sequence of the third guide face, the second guide face and the first guide face.

The guide faces may have bent borders.

The guide faces may have curved borders.

The other one of the first cam or the second cam may have a constant gradient at a portion thereof coming into contact with any one cam.

The spring may include a coil spring having a constant coefficient of elasticity.

It is to be understood that both the foregoing general description and the following detailed description of the present invention are exemplary and explanatory and are intended to provide further explanation of the present invention as claimed.

BRIEF DESCRIPTION OF THE DRAWINGS

The embodiments will be described in detail with reference to the following drawings in which like reference numerals refer to like elements wherein.

DETAILED DESCRIPTION

Figure 1:
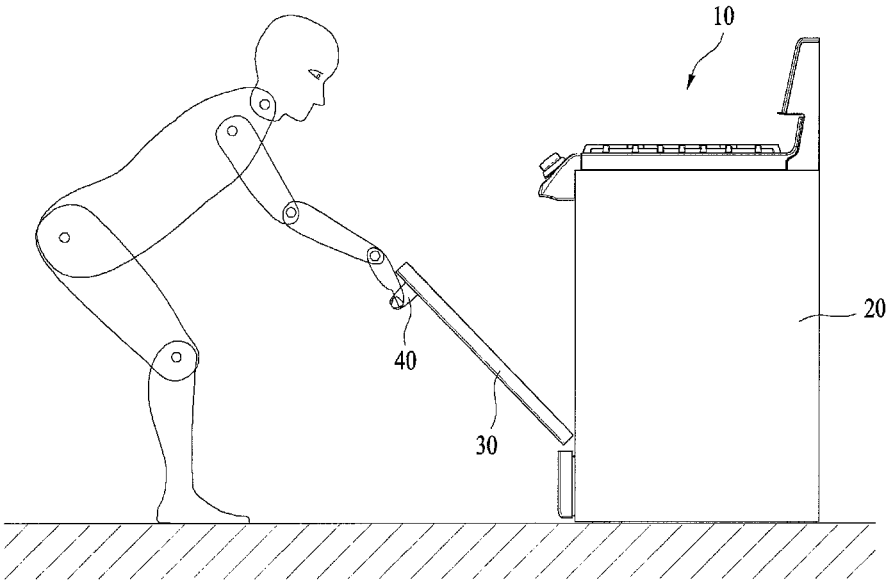
FIG. 1 is a schematic view showing opening/closing of a door of a home appliance according to the present invention.

Hereinafter, exemplary embodiments of the present invention that may realize the above-described object concretely will be described in detail with reference to the accompanying drawings.

The size, shape or the like of components shown in the drawings may be exaggerated for clarity and convenience of description. In addition, the terms, particularly defined by taking into consideration the configurations and functions of the present invention, may be replaced by other terms based on intensions of users or operators or customs. Hence, the meanings of these terms must follow definitions described in the entire specification.

FIG. 1 shows an open state of a door of a home appliance according to the present invention.

The home appliance shown in FIG. 1, designated by reference numeral 10, may be an oven or a dishwasher among a variety of home appliances. Specifically, the oven or dishwasher includes a door 30 provided at an upper portion of a front surface thereof with a handle 40, the door 30 being opened or closed by being rotated about a rotation center thereof located at a lower end of the door 30.

A user may open or close the door 30 by gripping the handle 40 installed to a front surface of a cabinet 20 and downwardly pushing the handle 40 while pulling the handle 40. Such a door may be referred to as a pull-down type door. Here, the handle 40 is fixed at the door 30.

In this case, due to the fact that the door 30 may be rapidly moved downward upon opening, the door 30 and the cabinet 20 have a risk of bouncing or damage by shock applied thereto. In addition, it is desirable that the door 30 be easily separable from the cabinet 20 in an initial rotation stage in which the door 30 is moved away from the cabinet 20. To this end, the present invention aims to improve door opening sensation control of a rotation speed of the door 30.

Figure 2:
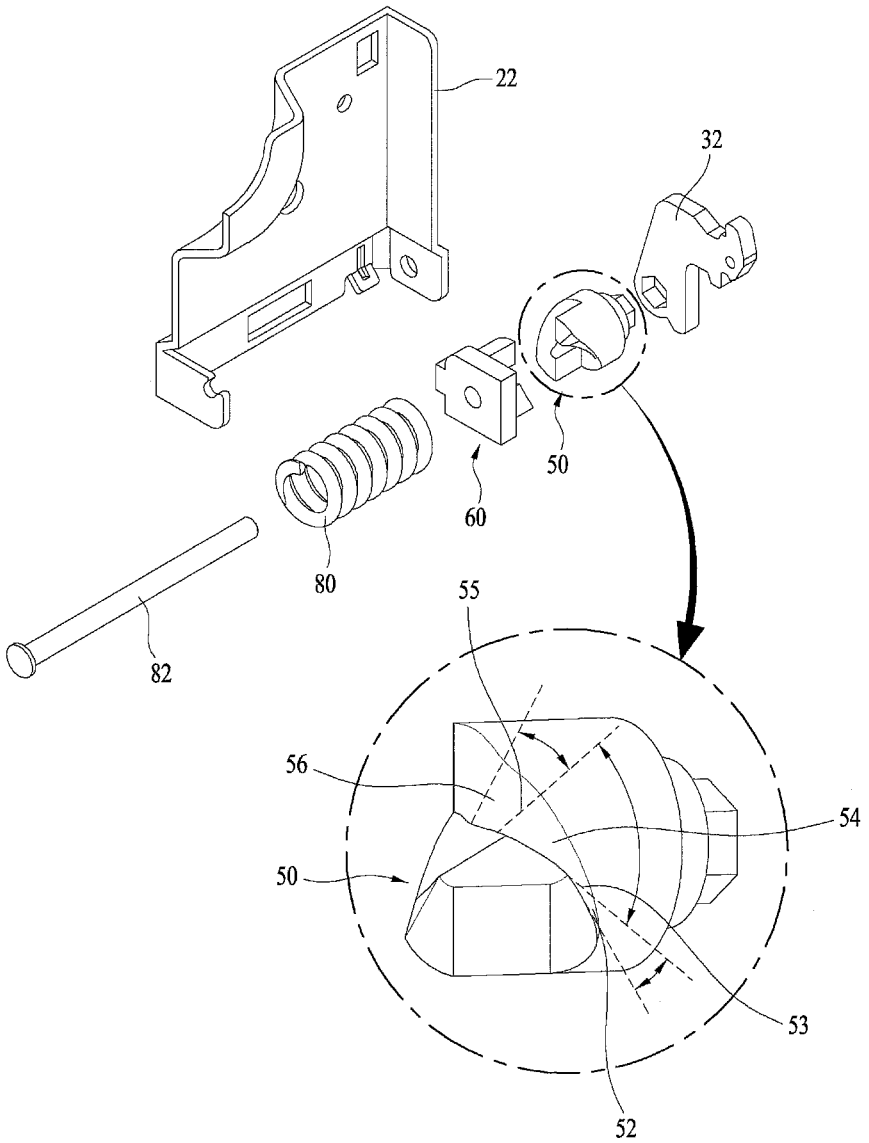
FIG. 2 is a view showing main components of a home appliance according to one embodiment of the present invention.
Figure 3:
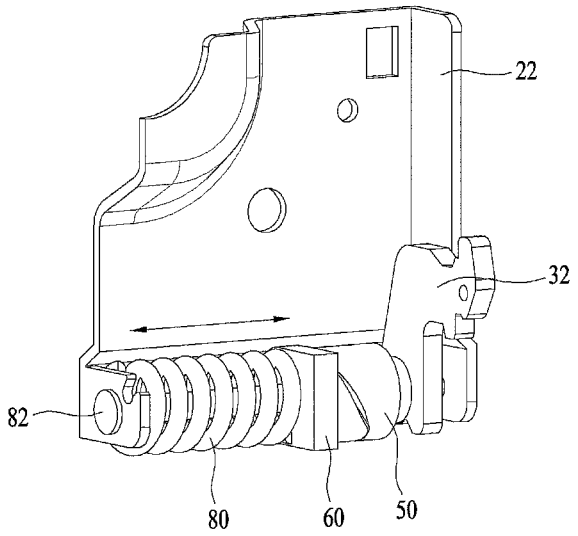
FIG. 3 is a view showing an assembled state of the components shown in FIG. 2.

FIG. 2 is a view showing main components of a home appliance according to one embodiment of the present invention, and FIG. 3 is a view showing an assembled state of the components shown in FIG. 2. A description with reference to FIGS. 2 and 3 is as follows.

The home appliance may include a bracket 22 defining a chamber. The bracket 22 may define a front surface of the chamber. In the drawing, for brief illustration, the bracket 22 is shown without the cabinet.

The bracket 22 may be provided with a coupling member 32 that is coupled to the door 30 and rotated along with the door 30. The coupling member 32 has the same rotation center as the door 30 and thus may transmit torque of the door 30 to other components. In the drawing, for brief illustration, the coupling member 32 is shown without the door 30.

In one embodiment of the present invention, the door 30 may include a cam assembly 50 and 60 coupled to the coupling member 32 and a spring 80 configured to be compressed by the cam assembly 50 and 60.

The cam assembly 50 and 60 and the spring 80 may be coupled to the bracket 22 using a shaft 82. The shaft 82 may be inserted through the spring 80 to fix a position of the spring 80.

The cam assembly 50 and 60 may convert rotation into horizontal linear motion upon rotation of the door 30. That is, the cam assembly 50 and 60 may change rotation of the door 30 into force to compress the spring 80.

In this case, the cam assembly 50 and 60 may include a first cam 50 configured to be rotated along with the door 30 and a second cam 60 configured to be linearly moved by rotation of the first cam 50. The first cam 50 and the second cam 60 are separate elements arranged to cooperate with each other. That is, the first cam 50 and the second cam 60 may be separated from each other by a distance to ensure that operation of the first cam 50 is transmitted to the second cam 60.

The second cam 60 may be moved in a horizontal direction, i.e. in a left-and-right direction to compress the spring 80. When the second cam 60 is moved to the spring 80, the second cam 60 compresses the spring 80. On the other hand, when the second cam 60 is moved away from the spring 80, the spring 80 is changed from a compressed state to a stretched state.

The first cam 50 may have a plurality of guide faces having different gradients at portions thereof coming into contact with the second cam 60. In this case, the guide faces may be arranged at one side of the first cam 50 to limit a horizontal movement distance of the second cam 60.

The guide faces may include a first guide face 52, a second guide face 54 and a third guide face 56 which extend in different directions for distinction therebetween. In this case, a bent portion 53 may be located between the first guide face 52 and the second guide face 54 and a bent portion 55 may be located between the second guide face 54 and the third guide face 56. The first guide face 52, the second guide face 54 and the third guide face 56 may be divided from one another by the bent portions 53 and 55.

Preferably, the second cam 60 is configured to enable rotation of the first cam 50. That is, the second cam 60 may be configured to prevent the rotating first cam 50 from being caught by the second cam 60 and unintentionally stopping rotation thereof, and is also configured to transmit rotation of the first cam 50 to the spring 80. A face of the second cam 60 coming into contact with the first cam 50 has a constant gradient. As such, the varying gradient of the first cam 50 may vary by a constant rate to thereby be transmitted to the spring 80.

That is, in the present invention, a horizontal linear movement distance of the second cam 60 to compress the spring 80 may vary according to a rotation angle of the door 30. Such variation of the movement distance may be accomplished by the guide faces 52, 54 and 56 of the first cam 50.

The spring 80 may be a coil spring having a constant coefficient of elasticity. In the present invention, a single spring is used rather than a plurality of springs, which may simplify design related to moment generated by rotation of the door 30.

Figure 4:
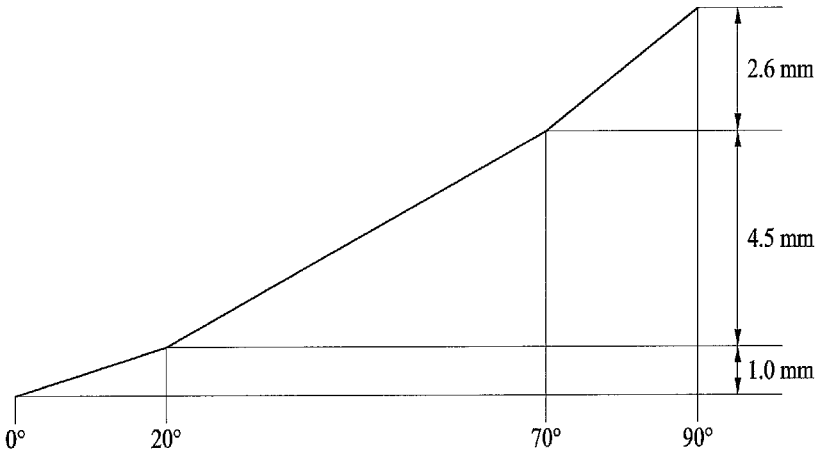
FIG. 4 is a graph explaining a shape of a first cam.
Figure 5:
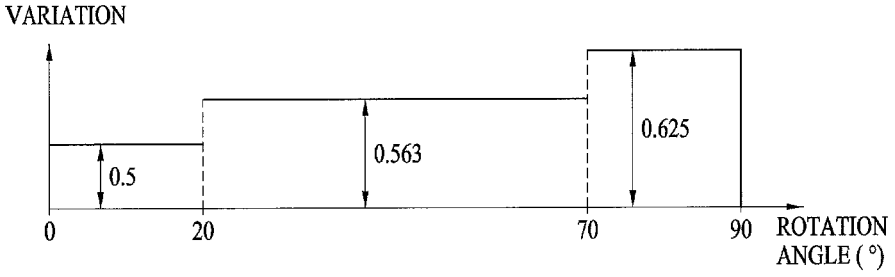
FIG. 5 is a view explaining variation of FIG. 4 in detail.

FIG. 4 is a graph explaining a shape of the first cam, and FIG. 5 is a view explaining variation of FIG. 4 in detail. A description with reference to FIGS. 4 and 5 is as follows.

The first cam 50 may be rotated along with the door 30. In FIGS. 4 and 5, the abscissa represents a rotation angle of the door 30, i.e. a rotated angle of the first cam 50 until the first cam 50 comes into contact with the second cam 60.

In the present invention, rotation of the door 30 may be limited based on predetermined angular sections including a first section between zero degrees and 20 degrees, a second section between 20 degrees and 70 degrees, and a third section between 70 degrees and 90 degrees.

Rotation of the door 30 in the first section may be guided by the first guide face 52, rotation of the door 30 in the second section may be guided by the second guide face 54 and rotation of the door 30 in the third section may be guided by the third guide face 56.

The first guide face 52 for the first section may have a gradient of 0.5 (a ratio of length/length), the second guide face 54 for the second section may have a gradient of 0.563 (a ratio of length/length), and the third guide face 56 for the third section may have a gradient of 0.625 (a ratio of length/length).

That is, the gradient of the third guide face 56 may be the greatest, the gradient of the second guide face 54 may be the next greatest, and the gradient of the first guide face 52 may be the smallest. Accordingly, upon rotation of the door 30, the second cam 60 may have the shortest horizontal movement distance when the first guide face 52 comes into contact with the second cam 60. Then, a horizontal movement distance of the second cam 60 when the second guide face 54 comes into contact with the second cam 60 may be greater than the horizontal movement distance of the second cam 60 when the first guide face 52 comes into contact with the second cam 60. Then, the second cam 60 may have the greatest horizontal movement distance when the third guide face 56 comes into contact with the second cam 60.

In this case, the first guide face 52 may have a constant gradient in the first section, the second guide face 54 may have a constant gradient in the second section, and the third guide face 56 may have a constant gradient in the third section.

Meanwhile, since variation in the horizontal movement distance increases from the first section to the second section and to the third section, the horizontal movement distance of the second cam 60 increases from the first section to the third section, causing greater compression of the spring 80. Accordingly, it will be appreciated that greater compression of the spring 80 may be accomplished on the basis of the same rotation angle as a chamber opening degree of the door 30 increases. That is, as an opening degree of the door 30 increases, force against rotation of the door 30 increases.

Figure 8:
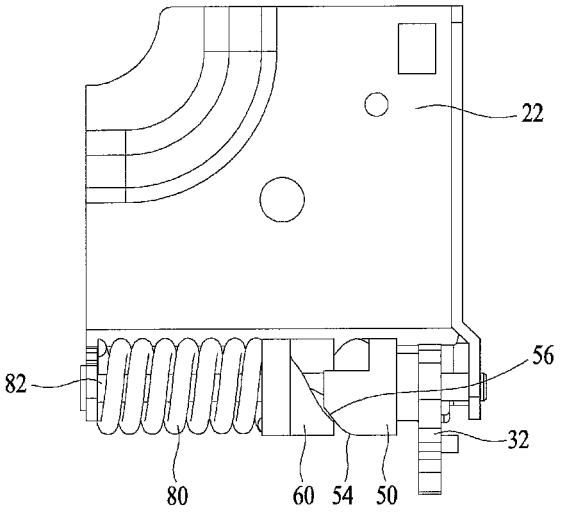
Figure 9:
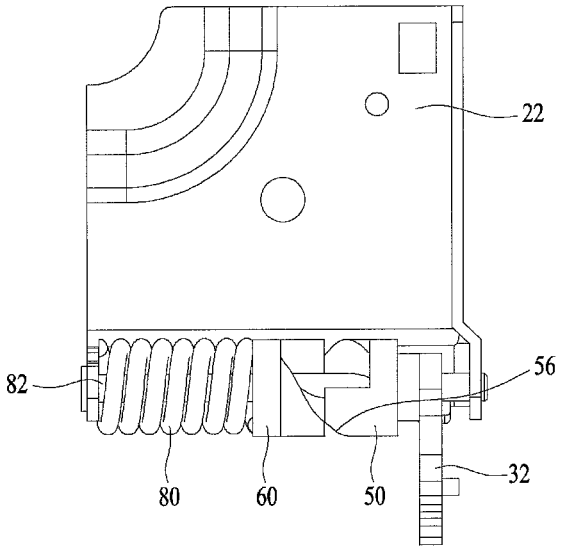
Figure 10:
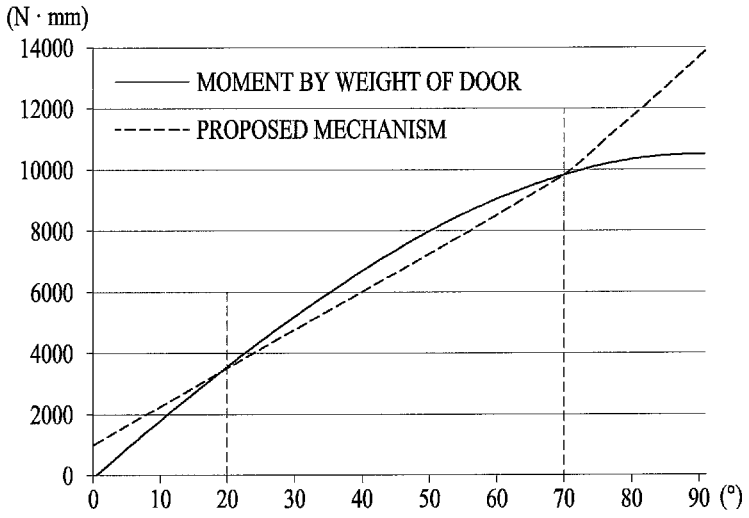
FIG. 10 is a view explaining operation of the present invention.

FIGS. 6 to 9 are views showing rotation of the door, and FIG. 10 is a view explaining operation of the present invention. A description with reference to FIGS. 6 to 10 is as follows.

Figure 6:
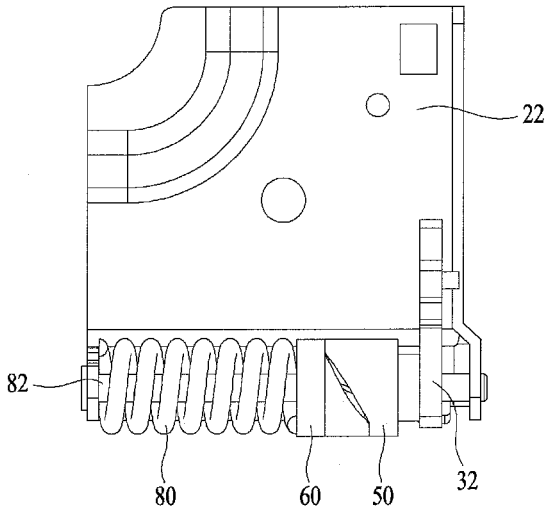
FIGS. 6 to 9 are views showing rotation of a door.
Figure 7:
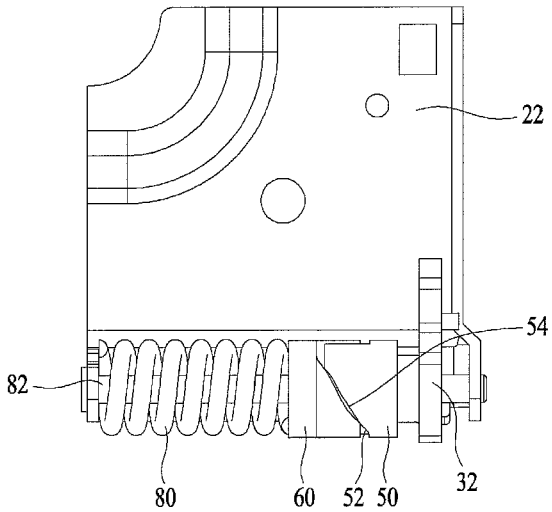

FIG. 6 shows a state in which the door 30 completely closes the chamber, i.e. a state in which the door 30 is rotated by zero degrees. FIG. 7 shows a state in which the door 30 is rotated by 20 degrees, FIG. 8 shows a state in which the door 30 is rotated by 70 degrees, and FIG. 9 shows a state in which the door 30 is rotated by 90 degrees, i.e. a state in which the door 30 completely opens the chamber.

As exemplarily shown in FIG. 10, as the door 30 is rotated, moment caused by the weight of the door 30 increases.

In this case, through provision of the cam assembly 50 and 60 according to one embodiment of the present invention, in the first section in which the door 30 is opened away from the cabinet 20 by an angle of zero degrees to 20 degrees, a mechanism generated by the cam assembly 50 and 60 and the spring 80 causes slightly greater moment than the moment generated by the weight of the door 30. As such, the door 30 may be rotated to open the chamber by less user force.

Then, in the second section in which the door 30 is opened away from the cabinet 20 by an angle of 20 degrees to 70 degrees, a mechanism generated by the cam assembly 50 and 60 and the spring 80 causes slightly less moment than the moment generated by the weight of the door 30. Thus, the door 30 may be easily rotated to open the chamber.

On the other hand, in the third section in which the door 30 is opened away from the cabinet 20 by an angle of 70 degrees to 90 degrees, a mechanism generated by the cam assembly 50 and 60 and the spring 80 causes considerably greater moment than the moment generated by the weight of the door 30, thereby preventing the door 30 from being rotated 90 degrees or more.

In this way, in the present invention, different moments are generated in the respective rotation angle sections. In other words, generation moment may vary according to a rotation angle of the door 30, i.e. a chamber opening degree by the door 30. Accordingly, it is possible to differently adjust values of moment to restrict rotation of the door 30 based on comfort of the user at a corresponding opening degree of the door 30.

Alternatively, differently from one embodiment of the present invention, no bent portion may be provided between the first guide face 52, the second guide face 54 and the third guide face 56, and borders of the respective guide faces may be curved. In such an alternative embodiment, when the user opens the door 30, the user may not perceive that the door 30 passes boundaries of the first guide face 52, the second guide face 54 and the third guide face 56 because the first guide face 52, the second guide face 54 and the third guide face 56 are successive.

However, even in the alternative embodiment of the present invention, the first guide face 52 may have a constant gradient in the first section, the second guide face 54 may have a constant gradient in the second section, and the third guide face 56 may have a constant gradient in the third section. Accordingly, rotation of the door 30 may be restricted as the magnitude of moment to restrict rotation of the door 30 varies based on a rotation angle of the door 30.

Figure 11:
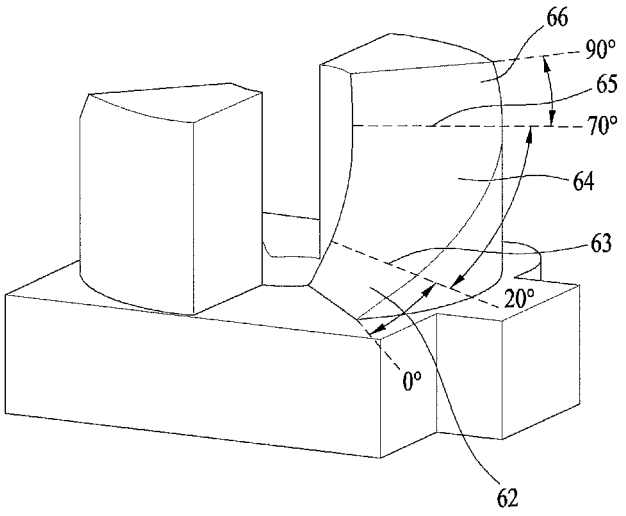
FIG. 11 is a view showing a second cam according to another embodiment of the present invention.

FIG. 11 is a view showing a second cam according to another embodiment of the present invention. A description with reference to FIG. 11 is as follows.

In another embodiment of the present invention, differently from the above-described embodiment, the second cam 60 may have a plurality of guide faces such that a movement distance of the second cam 60 varies according to a rotation angle of the door 30.

In this case, the guide faces of the second cam 60, i.e. a first guide face 62, a second guide face 64 and a third guide face 66 are configured based on the graphs as shown in FIGS. 4 and 5.

That is, since gradients of the first guide face 62, the second guide face 64 and the third guide face 66 increase in sequence, a movement distance of the second cam 60 to compress the spring 80 may increase as a rotation angle of the door 30 increases.

In another embodiment of the present invention in which the second cam 60 has the guide faces, the first cam 50 may have a constant gradient to correspond to the second cam 60 of the above-described embodiment. That is, variation of a movement distance of the second cam 60 to compress the spring 80 according to a rotation angle of the door 30 may be substantially adjusted only by the second cam 60.

The technical content according to another embodiment of the present invention is substantially equal to the above-described embodiment and, thus, a detailed description thereof is omitted.

As is apparent from the above description, it is impossible to improve door opening sensation upon opening of a door by a user. More particularly, the door may be easily separated from a cabinet by less force when the user begins to open the door. In addition, it is possible to prevent the door from being rotated 90 degrees or more when the user attempts to completely open the door. This may prevent damage to the door or cabinet due to unnecessary excessive rotation of the door relative to the cabinet.

Although the exemplary embodiments have been illustrated and described as above, of course, it will be apparent to those skilled in the art that the present invention is not limited to the above described particular embodiments, and various modifications and variations can be made in the present invention without departing from the spirit or scope of the present invention, and the modifications and variations should not be understood individually from the viewpoint or scope of the present invention.

What is claimed is:

1. A home appliance comprising:

a cabinet having a chamber configured to receive an object therein;

a door mounted to a front of the cabinet by a horizontal shaft to open or close the chamber;

a cam assembly configured to convert rotational movement of the door into horizontal linear movement upon rotation of the door; and a spring configured to be compressed by the horizontal linear movement of the cam assembly, wherein the cam assembly includes:

a first cam configured to rotate with the door; and a second cam configured to linearly move via rotation of the first cam, wherein at least one of the first cam or the second cam includes a first guide face having a first gradient, a second guide face adjacent to the first guide face and having a second gradient, and a third guide face adjacent to the second guide face and having a third gradient, and wherein the second gradient is greater than the first gradient, and the third gradient is greater than the second gradient.

2. The home appliance according to claim 1, wherein the amount of the horizontal linear movement of the cam assembly increases as the rotation angle of the door increases as the door is opened.

3. The home appliance according to claim 1, wherein each of the plurality of guide faces corresponding to a different range of the rotation angle of the door.

4. The home appliance according to claim 1, wherein an intersection between adjacent guide faces is bent at a prescribed angle.

5. The home appliance according to claim 1, wherein an intersection between adjacent guide faces is curved.

6. The home appliance according to claim 1, wherein a contact surface of the other one of the first cam or the second cam has a constant gradient.

7. The home appliance according to claim 1, wherein the spring includes a coil spring having a constant coefficient of elasticity.

8. The home appliance according to claim 1, wherein a moment caused by a weight of the door increases as the door is rotated, the cam assembly and the spring causes greater moment than the moment generated by the weight of the door in a first section in which the door is opened away from the cabinet by an angle of zero degrees to 20 degrees, the cam assembly and the spring causes less moment than the moment generated by the weight of the door in a second section in which the door is opened away from the cabinet by an angle greater than 20 degrees to 70 degrees, and the cam assembly and the spring causes greater moment than the moment generated by the weight of the door in a third section in which the door is opened away from the cabinet by an angle greater than 70 degrees to 90 degrees.

9. A home appliance comprising:

a cabinet;

a door mounted to a front of the cabinet by a horizontal shaft;

a first cam coupled to the cabinet and configured to convert rotational movement of the door into horizontal linear movement upon rotation of the door;

a second cam configured to linearly move via rotation of the first cam; and a spring configured to be compressed by the horizontal linear movement of the second cam, wherein a guide face of the first cam that contacts the second cam has a prescribed shape to vary the amount of horizontal linear movement of the second cam, the guide face including:

a first surface having a first gradient, a second surface provided adjacent to the first surface and having a second gradient, and a third surface provided adjacent to the second surface and having a third gradient, wherein the first gradient, the second gradient, and the third gradient are different from one another, and wherein the second gradient of the second surface is greater than the first gradient of the first surface such that the spring is compressed at a greater rate through the second surface than the first surface and the third gradient of the third surface is greater than the second gradient of the second surface such that the spring is compressed at a greater rate through the third surface than the second surface.

10. The home appliance according to claim 9, wherein the spring is provided adjacent to the second cam to exert a force in a first direction, the second cam is configured to move linearly in the first direction, and the first cam is provided adjacent the second cam and configured to move the second cam in a second direction opposite to the first direction.

11. The home appliance according to claim 10, wherein the spring, the second cam and the first cam are linearly aligned in the first direction, parallel to a rotational axis of the first cam.

12. The home appliance according to claim 9, wherein the second gradient of the second surface is greater than the first gradient of the first surface such that the spring is compressed at a greater rate through the second surface than the first surface.

13. The home appliance according to claim 9, wherein the first gradient, the second gradient, and the third gradient are constant.

14. The home appliance according to claim 9, wherein the first surface of the first cam corresponds to, a first angular range of the door relative to the cabinet that extends from a closed position to a first prescribed angle of the door, the second surface of the first cam corresponds to a second angular range of the door that extends from the first prescribed angle to a second prescribed angle of the door, and the third surface of the cam corresponds to a third angular range of the door that extends from the second prescribed angle to a fully open position of the door.

15. The home appliance according to claim 14, wherein the cam assembly is configured to transfer a force from the spring to the door to counteract a weight of the door, wherein the force is increased at a greater rate when the door is positioned in the second angular range than the first range and increased at a greater rate when the door is positioned in the third angular range than the first and second angular ranges.

* * * * *